US011137233B1

(12) United States Patent
Liu

(10) Patent No.: US 11,137,233 B1
(45) Date of Patent: Oct. 5, 2021

(54) SLIDE PLATE TARGET-DROP HOLE CHANGING STRUCTURE FOR AUTO TARGET THROWING TRAP

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 17/199,542

(22) Filed: Mar. 12, 2021

(51) Int. Cl.
*F41J 9/30* (2006.01)

(52) U.S. Cl.
CPC ..... *F41J 9/30* (2013.01)

(58) Field of Classification Search
CPC ..... F41J 9/18; F41J 9/30
USPC ..... 124/6, 7, 8, 46, 47
See application file for complete search history.

(56) References Cited

U.S. PATENT DOCUMENTS 2,432,155 A * 12/1947 Herold ..... F41J 9/18 124/6
2,603,203 A * 7/1952 Herold ..... F41J 9/30 124/6
2,928,383 A * 3/1960 Ohlson ..... F41J 9/30 124/8
3,677,257 A * 7/1972 Segerkvist ..... F41J 9/30 124/8
3,841,293 A * 10/1974 Laporte ..... F41J 9/30 124/8
3,937,203 A * 2/1976 Riedmueller ..... F41J 9/24 124/8
4,706,641 A * 11/1987 Cote ..... F41J 9/30 124/32
4,967,720 A * 11/1990 McCord ..... F41J 9/30 124/47
5,036,828 A * 8/1991 Heffer ..... F41J 9/30 124/47
7,263,986 B2 * 9/2007 Lovell ..... F41J 9/24 124/9
9,389,050 B1 * 7/2016 Chen ..... F41J 9/30
10,365,072 B1 * 7/2019 Liu ..... F41J 9/32
10,458,760 B1 * 10/2019 Liu ..... F41J 9/30
2012/0138034 A1 * 6/2012 Whidborne ..... F41J 9/18 124/8

* cited by examiner

*Primary Examiner* — Alexander R Niconovich
(74) *Attorney, Agent, or Firm* — Demian K. Jackson; Jackson IPG PLLC

(57) ABSTRACT

A slide plate target-drop hole changing structure used in an auto target throwing trap is disclosed to include a slide plate slidably coupled to an upper cover plate of the auto target throwing trap and provided with a first target-drop hole for large-size targets to drop down from a target-drop opening of the upper cover plate through the first target drop hole, and a filling piece detachably connected to the slide plate. When the filling piece is connected to the slide plate, a second target-drop hole is formed between a concave arc gap of the filling piece and the first target-drop hole of the slide plate for the passing of small-sized targets.

3 Claims, 8 Drawing Sheets

SLIDE PLATE TARGET-DROP HOLE CHANGING STRUCTURE FOR AUTO TARGET THROWING TRAP

BACKGROUND AND SUMMARY OF THE INVENTION

The present invention relates to throwing trap technology and more particularly, to a slide plate target-drop hole changing structure for auto target throwing trap, which allows change of the size of the target-drop hole for the passing of large-sized or small-sized targets.

The auto target throwing trap of the prior art design is suitable for large-size target (standard target). In addition, there are also auto target throwing traps suitable for small size targets on the market. If the user has the possibility of training needs for large and small targets, he must purchase other special-sized auto target throwing traps. Not only is it inconvenient to use, but it also costs multiple auto target throwing traps, and multiple auto target throwing traps take up more space. In addition, China Patent No. 201821831355.5 and the Patent No. 201920119816.4 of the present inventor also disclose some related technologies of the target-drop structure.

The present invention has been accomplished under the circumstances in view. It is therefore the main object of the present invention to provide a slide plate target-drop hole changing structure for use in an auto target throwing trap, which comprises a slide plate slidably coupled to an upper cover plate of the auto target throwing trap and provided with a first target-drop hole for large-size targets to drop down from a target-drop opening of the upper cover plate through the first target drop hole, and a filling piece detachably connected to the slide plate. When the filling piece is connected to the slide plate, a second target-drop hole is formed between a concave arc gap of the filling piece and the first target-drop hole of the slide plate for the passing of small-sized targets. When the filling piece of different specifications and sizes is changed, the size of the target-drop hole is relatively changed. Therefore, an auto target throwing trap only needs to be connected with a filling piece of different specifications to be suitable for targets of various sizes such as large, medium and small, which saves costs and does not take up space.

Furthermore, the filling piece can be easily connected to or detached from the slide plate, the operation is simple and easy, and it is also convenient for users to do it themselves (DIY).

DETAILED DESCRIPTION OF THE INVENTION

Figure 1:
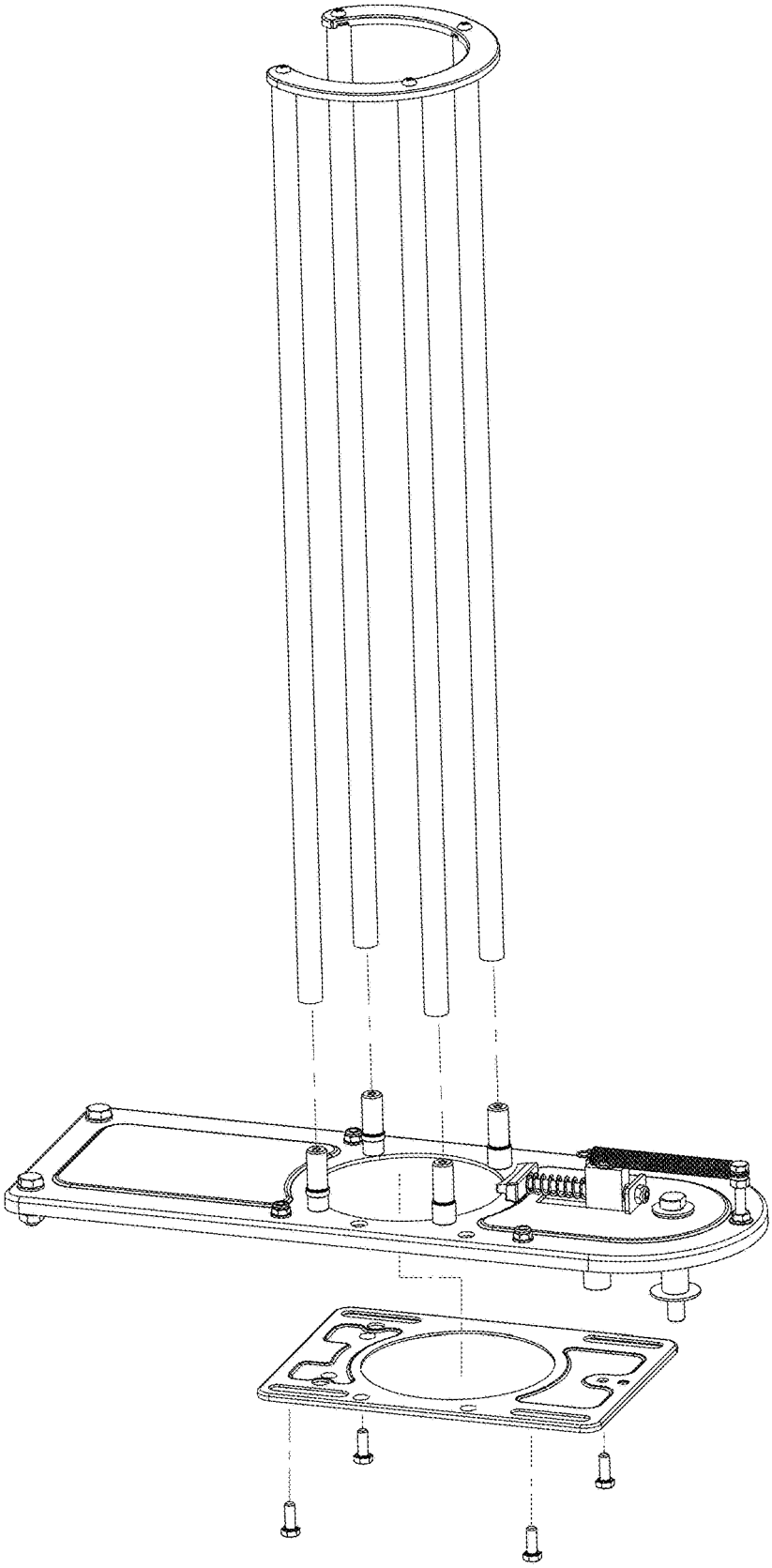
Fig. 1 PRIOR ART
FIG. 1 is an exploded view of a target-drop structure for auto target throwing trap according to the prior art.
Figure 2:
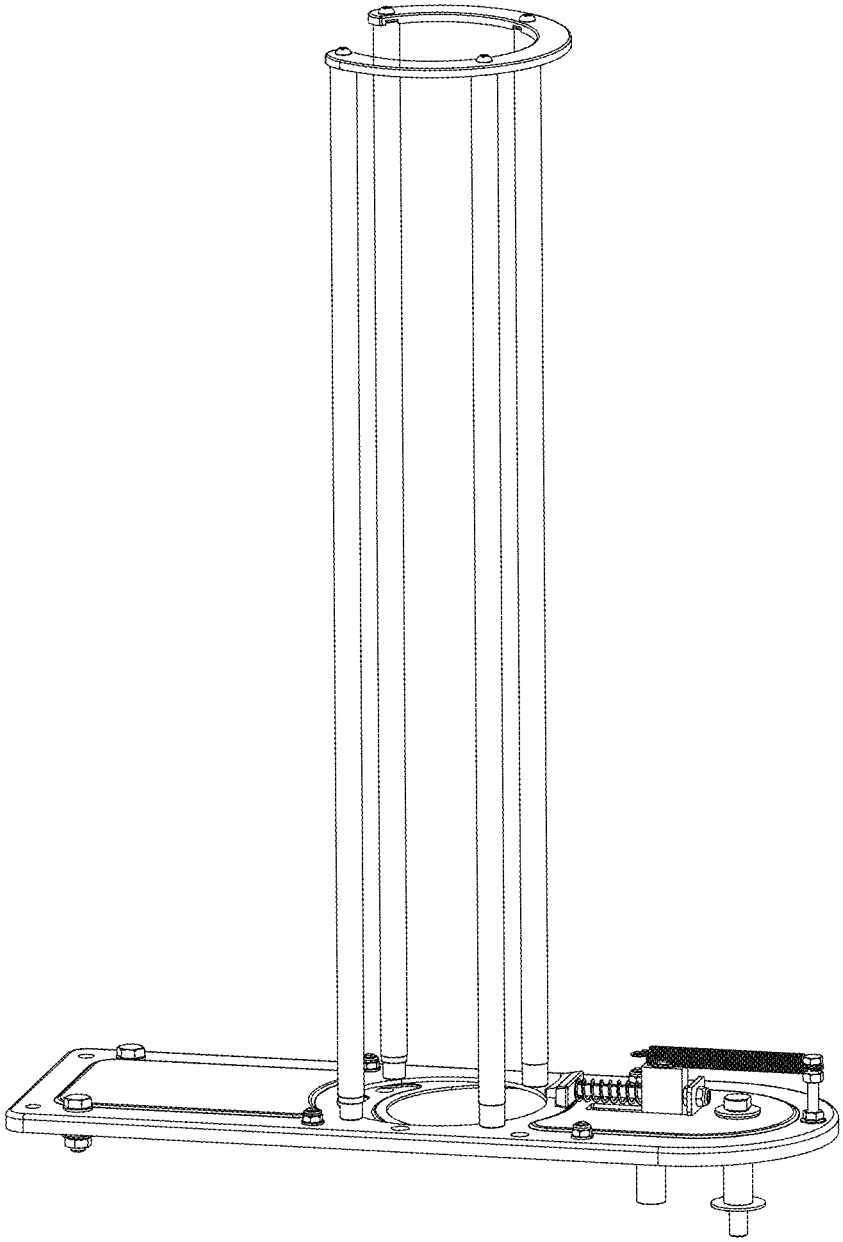
Fig. 2 PRIOR ART
FIG. 2 is an elevational assembly view of FIG. 1.
Figure 3:
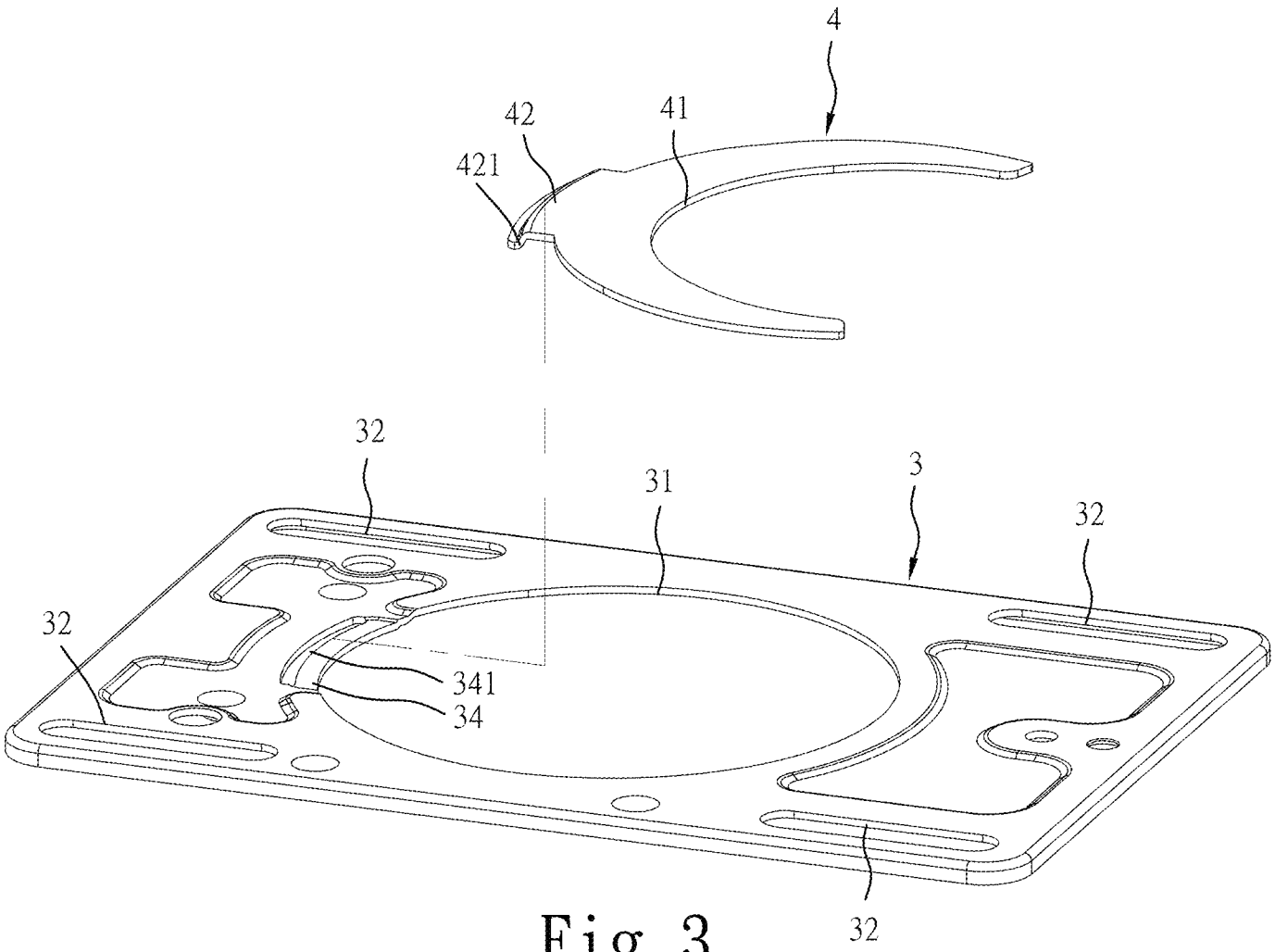
FIG. 3 is an exploded view of a slide plate and a filling piece of a slide plate target-drop hole changing structure for auto target throwing trap in accordance with the present invention.
Figure 4:
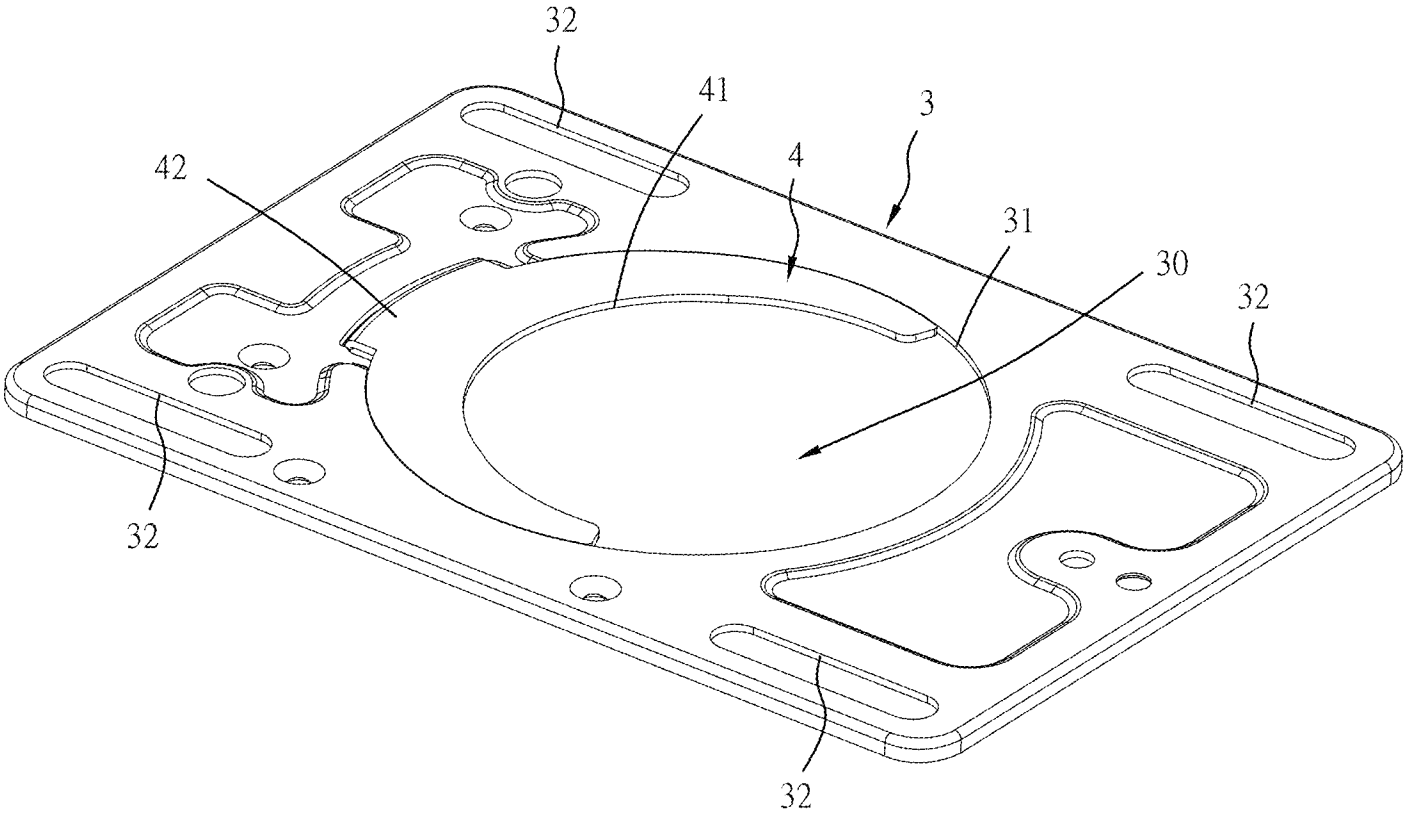
FIG. 4 is an elevational assembly view of FIG. 3.
Figure 5:
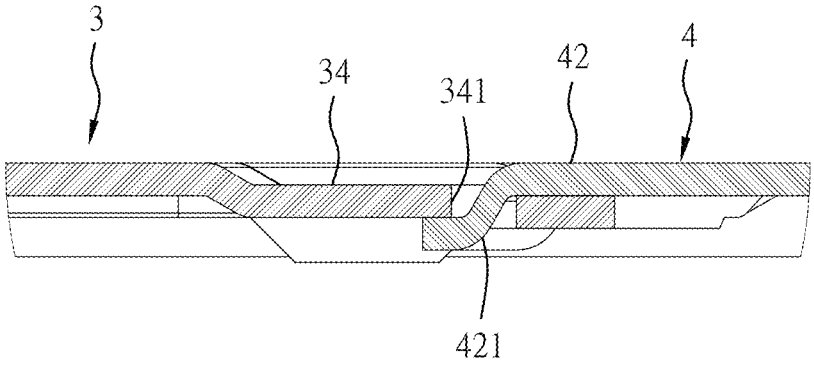
FIG. 5 is a sectional view, in an enlarged scale, of the assembly of the slide plate and the filling piece shown in FIG. 4.
Figure 6:
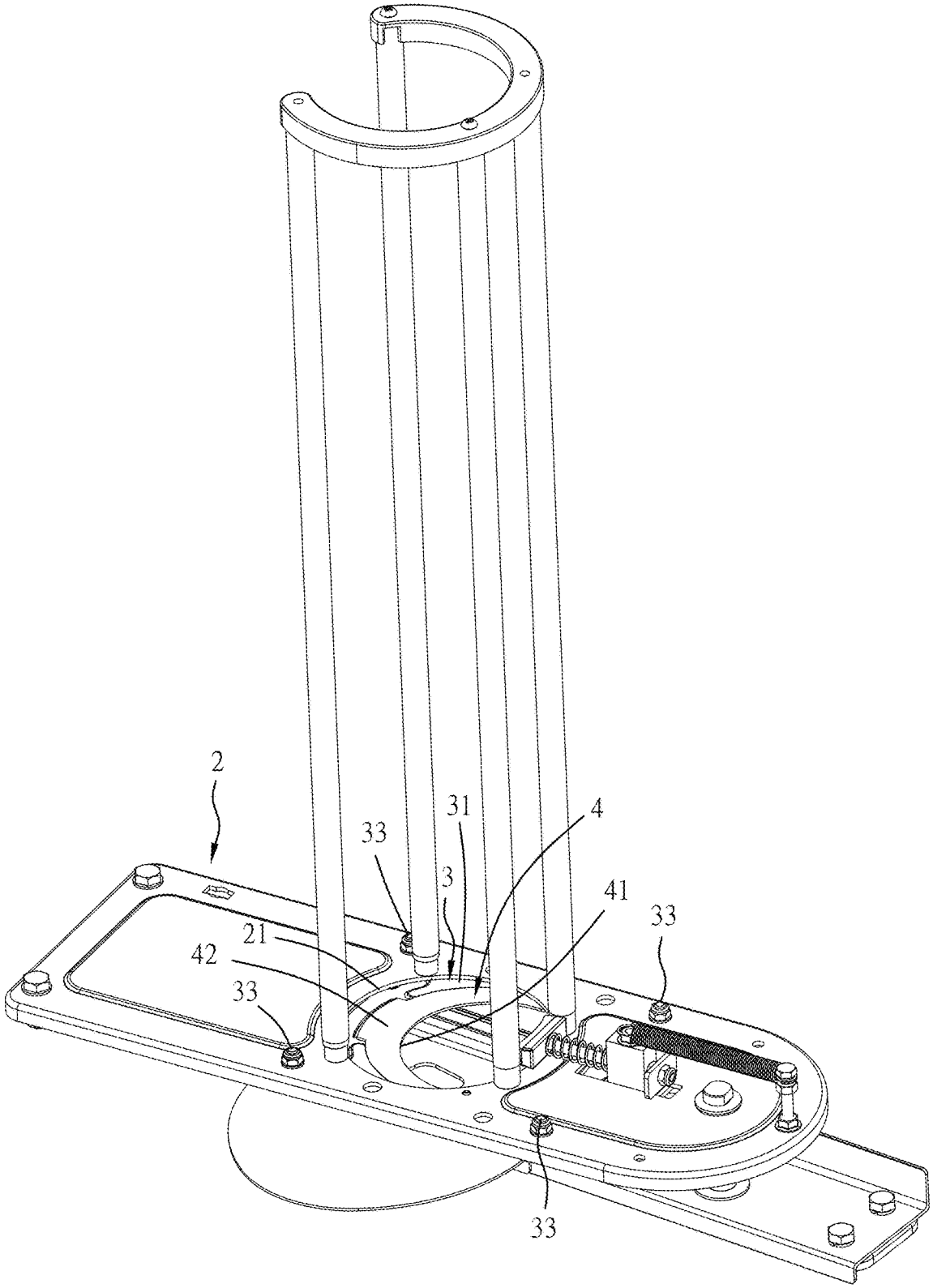
FIG. 6 is an elevational view of the present invention, illustrating the slide plate target-drop hole changing structure mounted to the upper cover plate of the auto target throwing trap.

Referring to FIGS. 3-6, a slide plate target-drop hole changing structure for auto target throwing trap in accordance with the present invention comprises a slide plate 3. The slide plate 3 is distributed with elongated sliding slots 32 in a forward-backward direction (refer to FIGS. 3 to 4). The elongated sliding slots 32 are respectively and slidably connected to a bottom surface of an upper cover plate 2 by positioning members 33, so that the slide plate 3 can slide in the forward-backward direction relatively to the bottom surface of the upper cover plate 2. The slide plate 3 has a first target-drop hole 31 for a large-size target (standard target) (not shown) to drop down from a target-drop opening 21 of the upper cover plate 2 through the first target drop hole 31.

The main feature of the present invention is outlined hereinafter.

The slide plate 3 has a recessed surface 34 adjacent to a rear side of the first target-drop hole 31 (refer to FIGS. 3 and 5), and a filling piece 4 is detachably connected to the recessed surface 34 (refer to FIGS. 3 to 6). The filling piece 4 has a concave arc gap 41 on a front side thereof (refer to FIGS. 3 to 4 and FIG. 6), so that a second target-drop hole 30 (see FIG. 4) can be formed between the concave arc gap 41 and the first target-drop hole 31 for the passing of small-sized targets (not shown).

Furthermore, the recessed surface 34 of the slide plate 3 is provided with at least one positioning slot 341 (refer to FIGS. 3 and 5), and the rear side of the filling piece 4 forms a positioning portion 42 corresponding to the recessed surface 34. The positioning portion 42 is correspondingly provided with at least one positioning hook 421. The filling piece 4 is detachably connected to the slide plate 3 by placing the positioning portion 42 in the recessed surface 34 and forcing the at least one positioning hook 421 into engagement with the at least one positioning slot 341.

Figure 7:
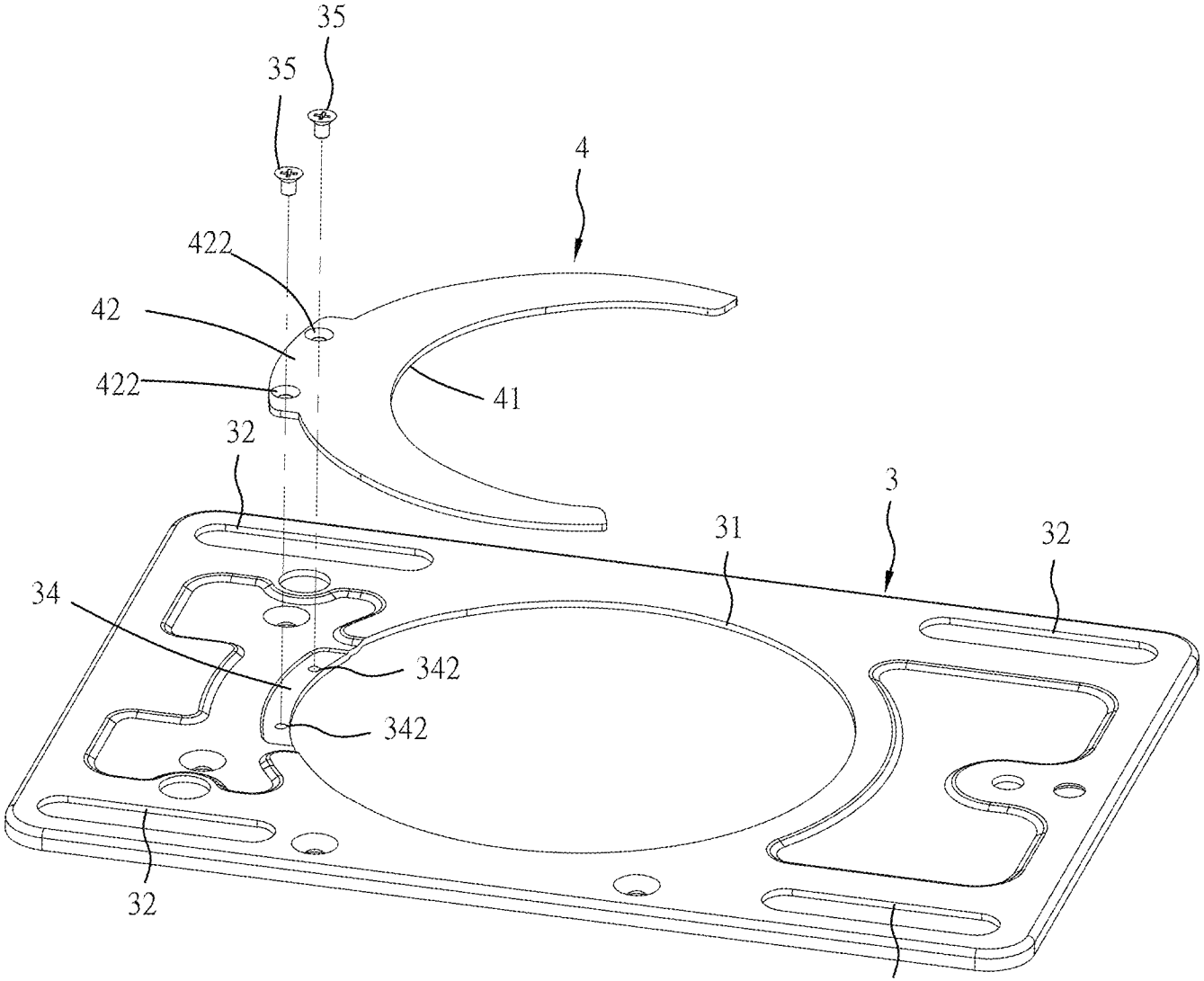
FIG. 7 is an exploded view of an alternate form of the slide plate target-drop hole changing structure for auto target throwing trap in accordance with the present invention.
Figure 8:
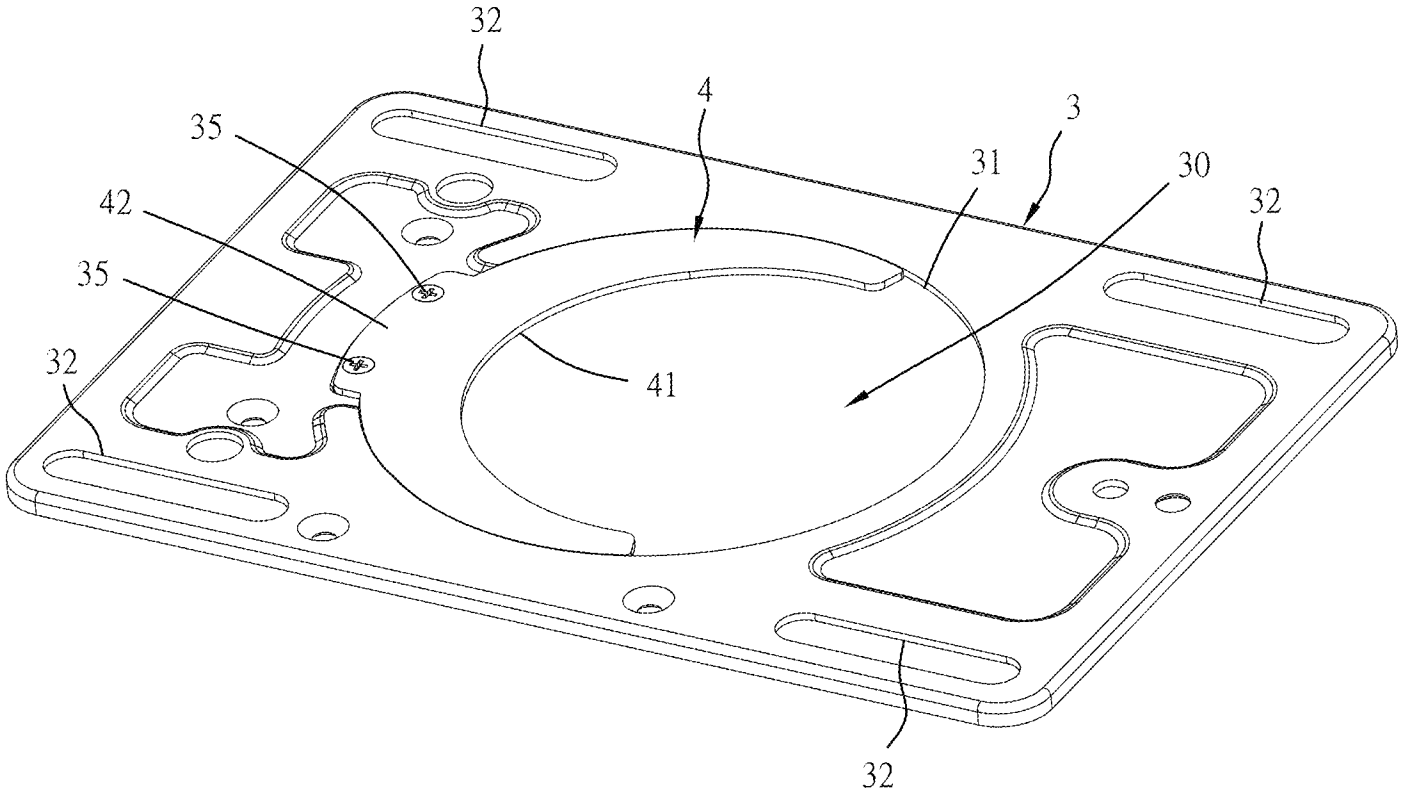
FIG. 8 is an elevational assembly view of slide plate target-drop hole changing structure shown in FIG. 7.

In an alternate form of the present invention, as shown in FIG. 7, the recessed surface 34 of the slide plate 3 is provided with at least one screw hole 342 (see FIG. 7), and the positioning portion 42 of the filling piece 4 is provided with at least one positioning hole 422. The filling piece 4 is detachably connected to the slide plate 3 by placing the positioning portion 42 in the recessed surface 34 and then mounting one fastening member such as screw 35 in each positioning hole 422 and the corresponding screw hole 342 (see FIG. 8). When the filling piece 4 is connected to the slide plate 3, a second target-drop hole 30 is formed between the concave arc gap 41 and the first target-drop hole 31 for the passing of small-sized targets.

In summary, the invention of the present invention can be summarized as having the following enhancement effects:

1. After removal of the filling piece 4 from the slide plate 3, the first target-drop hole 31 of the slide plate 3 is fully opened for large-size targets to drop down from the target-drop opening 21 of the upper cover plate 2 through the first target drop hole 31. When the filling piece 4 is connected to the slide plate 3, the second target-drop hole 30 formed between the concave arc gap 41 and the first target-drop hole 31 is used for the passing of small-sized targets. When the filling piece 4 of different specifications and sizes is changed, it is relatively possible to use the concave arc gap 41 of different sizes and the first target-drop hole 31 to form other target-drop holes of different sizes (other target-drop holes of different sizes are not shown in this embodiment). Therefore, an auto target throwing trap only needs to be connected with a filling piece 4 of different specifications to be suitable for targets of various sizes such as large, medium and small, which saves costs and does not take up space.

2. The filling piece 4 can be easily connected to or detached from the slide plate 3, the operation is simple and easy, and it is also convenient for users to do it themselves (DIY).

What is claimed is:

1. A slide plate target-drop hole changing structure used in an auto target throwing trap, comprising a slide plate slidably coupled to a bottom surface of an upper cover plate of said auto target throwing trap, said slide plate being provided with a first target-drop hole for a large-size target to drop down from a target-drop opening of said upper cover plate through said first target drop hole;

wherein said slide plate comprises a recessed surface adjacent to a rear side of said first target-drop hole, and a filling piece having a concave arc gap on a front side thereof is detachably connected to said recessed surface of said slide plate; when said filling piece is connected to said recessed surface of said slide plate, a second target-drop hole is formed between said concave arc gap and said first target-drop hole for the passing of small-sized targets.

2. The slide plate target-drop hole changing structure as claimed in claim 1, wherein said recessed surface of said slide plate is provided with at least one positioning slot; said filling piece comprises a positioning portion located at a rear side thereof and detachably placed in said recessed surface, and at least one positioning hook extended from said positioning portion and respectively detachably fastened to said at least one positioning slot.

3. The slide plate target-drop hole changing structure as claimed in claim 1, wherein said recessed surface of said slide plate is provided with at least one screw hole; said filling piece comprises a positioning portion located at a rear side thereof and detachably placed in said recessed surface, and at least one positioning hole cut through said positioning portion and respectively detachably fastened to said at least one screw hole by at least one fastening member.

* * * * *